US007039984B1

(12) United States Patent
Watanabe et al.

(10) Patent No.: US 7,039,984 B1
(45) Date of Patent: May 9, 2006

(54) HANDLE FOR TOOTH CLEANING MEMBER

(75) Inventors: Takayuki Watanabe, Nishigo-mura (JP); Norio Matsumoto, Hiratsuka (JP); Akinori Ikeda, Tokyo (JP)

(73) Assignee: Johnson and Johnson, New Brunswick, NJ (US)

( * ) Notice: Subject to any disclaimer, the term of this patent is extended or adjusted under 35 U.S.C. 154(b) by 393 days.

(21) Appl. No.: 10/148,107

(22) PCT Filed: Nov. 24, 2000

(86) PCT No.: PCT/JP00/08300

§ 371 (c)(1),
(2), (4) Date: Aug. 27, 2002

(87) PCT Pub. No.: WO01/37700

PCT Pub. Date: May 31, 2001

(30) Foreign Application Priority Data

Nov. 25, 1999 (JP) ..... 11/334284
May 26, 2000 (JP) ..... 2000-157233

(51) Int. Cl.
*A46B 5/00* (2006.01)

(52) U.S. Cl. ..... 15/167.1; 15/172

(58) Field of Classification Search ..... 15/144.1, 15/167.1, 172
See application file for complete search history.

(56) References Cited

U.S. PATENT DOCUMENTS 2,273,207 A * 2/1942 Kuhn ..... 15/167.1
6,003,189 A 12/1999 Falleiros

FOREIGN PATENT DOCUMENTS

| | | |
|---|---|---|
| EP | 0 454 625 | 10/1991 |
| GB | 2297478 | 8/1996 |
| JP | 57-36140 | 2/1983 |
| JP | 3-500494 | 2/1991 |
| JP | 4-269905 | 9/1992 |
| JP | 07-327737 | 12/1995 |
| WO | WO 89/10076 | 11/1989 |
| WO | WO 92/15224 | 9/1992 |

* cited by examiner

*Primary Examiner*—Mark Spisich
(74) *Attorney, Agent, or Firm*—Nutter, McClennen & Fish LLP

(57) ABSTRACT

This invention provides a handle for a tooth cleaning member convenient for use in which the angle of the tooth cleaning member can be easily adjusted for cleaning teeth only by controlling the force for grasping the grip part. The handle comprises a support portion made of an elastic material, and a pressed portion shorter than the support portion. When the pressed portion is pressed against the support portion, the support portion is transformed to increase its curvature.

30 Claims, 15 Drawing Sheets

VIB
VIID
45°
45°
20°
Y
1
2
3
4
5
5a
5b
6
7
8
16

HANDLE FOR TOOTH CLEANING MEMBER

TECHNICAL FIELD

This invention relates to a handle, grasped by a user's hand, for a tooth cleaning member, e.g., a toothbrush or an interdental brush.

BACKGROUND ART

A conventional toothbrush generally has a head and a handle. The handle is formed to be straight or curvilinear and cannot be transformed.

It is difficult for such a brush to contact the backside of teeth or between teeth at proper angles. Furthermore, the toothbrush cannot sufficiently match up to various teeth orientations of users.

In order to solve these problems, handles capable of adjusting the angle of a toothbrush head have been developed, publicly known and disclosed in the following publications.

First Conventional Technique Described in JP-A-3(1991)-500494

This publication discloses a handle for a toothbrush where a brush head is rotatably supported in an end of the handle, two parallel handle members are provided in the other end of the handle and the two handle members are coupled by a flexible intermediate layer or web. By virtue of the handle for the toothbrush, the angle of the brush head can be adjusted by relative movement of the two handle members in the longitudinal direction.

Second Conventional Technique Described in JP-U-57 (1982)-36140

This publication discloses a toothbrush having a handle part and a brush part that are independently manufactured and coupled with each other. The handle part is formed by overlapping two members each other, so that the vicinity of the connected portion on the handle part can be bent. It is described that the two members constituting the handle part can be relatively slided in the longitudinal direction to allow the angle adjustment of the brush part.

Third Conventional Technique Described in JP-A-4 (1992)-269905

This publication discloses a toothbrush of a closed-loop configuration that can be transformed for adjustment of its curvature by finger compression. This toothbrush has a closed loop configuration including the handle and the head. The curvature of the brush head can be adjusted by compressing the handle.

Fourth Conventional Technique Described in JP-A-6 (1994)-504937

This publication discloses a toothbrush using an elastic buckling arc for notifying the user of excessive brushing pressure. The neck portion near the brush head of this toothbrush is of a two-beam structure having a front (face-side) beam part and a rear beam part. A buckling hinge is disposed in the rear beam part such that excessive brushing pressure makes the buckling hinge buckle elastically and move toward the front beam part, thereby notifying the user that the brushing pressure is excessive.

Fifth Conventional Technique Described in JP-A-8(1996)-332116

This publication discloses a toothbrush of which a part between the head and handle can be elastically bent due to the force applied by the user such that brushing pressure on teeth and gums can be properly adjusted. A neck portion between the head and the handle of this toothbrush is constructed of two beams with an aperture therebetween so that the neck portion can be bent.

However, in the above-mentioned first and second conventional techniques, the relative movement of the two handle members in the longitudinal direction thereof is required to adjust the angle of the brush head. Thus, the user of such a toothbrush must apply a force for adjusting the angle of the brush head in the longitudinal direction of handle members, while cleaning his teeth. Alternatively, the user must clean his teeth after the angle of the brush head has been adjusted. In both the cases, whenever he adjusts the angle of the brush head, he must move his thumb so that a grasped part is not stable. Consequently, the conventional technique has a problem that it is difficult for the user to adjust the force for tooth brushing.

Furthermore, there is an additional problem in the first and second conventional techniques that the construction is complex and costly. For these reasons, they have not been practically utilized.

Next, in the above-mentioned third conventional technique, when the closed-loop like handle is compressed, the brush surface on the head at the distal end of the handle is also bent into a convex shape. Therefore, the toothbrush has a problem that it is difficult to hold the entire brush on the head uniformly in contact with teeth and gums with the equal pressure. Furthermore, since the handle may pinch a finger in the closed loop during the compressing operation, it is not easy for the user to use the toothbrush. In addition, there is another problem that the end of the handle may fatigue and be broken in a short time due to repetitive compression of the handle.

Next, in the above-mentioned fourth conventional technique, the toothbrush has a problem that the head angle can be changed only when the brushing pressure is excessive. The head angle cannot be changed optionally according to the part to be cleaned, e.g., front teeth or back teeth. The toothbrush with the buckling hinge has another problem in strength that the toothbrush is likely to be broken at the buckling part.

Next, in the above-mentioned fifth conventional technique, the neck portion can be bent by the force applied to the toothbrush. However, even when the neck portion is bent, the head angle to teeth remains unchanged. Thus, the toothbrush has a problem that the head angle cannot be properly and optionally adjusted for various teeth orientations or various parts to be cleaned.

The invention has been made to solve the above-described problems. An object of the present invention is to provide a handle for a tooth cleaning member convenient for use wherein the angle of the tooth cleaning member can be easily adjusted to a proper and desired angle for cleaning teeth only by controlling a force for grasping the grip part.

Another object of the present invention is to provide a handle for a tooth cleaning member wherein the angle of the cleaning member can be adjusted in a wide range.

Still another object of the present invention is to provide a handle for a tooth cleaning member of which the structure is simple and, therefore, easy to be manufactured at low cost in high production efficiency.

A further object of the present invention is to provide a handle for a tooth cleaning member capable of being easily washed or cleansed.

A still further object of the present invention is to provide a handle for a tooth cleaning member capable of selectively being used either as a toothbrush or as an interdental brush.

A still further object of the present invention is to provide a handle for a tooth cleaning member wherein the shape of the brush on the head can be easily changed so that all teeth can be smoothly cleaned within a mouth.

A still further object of the present invention is to provide a handle for a tooth cleaning member having an aperture in the grip part while the user's finger can be prevented from being pinched in the aperture, the interior surface of the aperture can be easily cleaned, and the neck portion can be easily transformed to a desired angle for cleaning teeth.

A still further object of the present invention is to provide a handle for a tooth cleaning member wherein a grip part with an aperture has sufficient strength to prevent its breakage.

A still further object of the present invention is to provide a handle for a tooth cleaning member wherein the interior surface of the aperture can be easily cleaned with a bar-like cleaning tool such as a swab, and the handle is easily manufactured by molding from a resin material in a die, allowing the long durability of the die.

A still further object of the present invention is to provide a handle for a tooth cleaning member capable of being easily manipulated when pressing a grip part or cleaning teeth.

A still further object of the present invention is to provide a handle for a tooth cleaning member wherein elastic transformation of a grip part can be optionally stopped so that the toothbrush can be used as a general integral toothbrush at the stopped position.

DISCLOSURE OF THE INVENTION

A handle for a tooth cleaning member having a neck portion arranged at one of the longitudinal ends, a head portion extending from a distal end of the neck portion for supporting the tooth cleaning member, and a grip tail portion arranged at the other longitudinal end according to an aspect of the present invention comprises: a support portion and a pressed portion, whose distal ends being integrated at a proximal end of the neck portion and whose proximal ends being integrated at a distal end of the grip tail portion, the support portion and the pressed portion being made of an elastic material and being separated from each other between the proximal end of the neck portion and the distal end of the grip tail portion, wherein when the pressed portion is pressed against the support portion, at least one of the pressed portion and the support portion is elastically transformed in a direction of placing the tooth cleaning member in contact with the teeth or gums to adjust a tooth brushing angle of the head portion to a proper angle.

With such a structure, since the support portion and the pressed portion extend in a longitudinal direction of the handle and are separated from each other between the proximal end of the neck portion and the distal end of the grip tail portion, the support portion and the pressed portion can be easily grasped when cleaning teeth.

Further, when cleaning teeth the user enters a part extending from the tooth cleaning member at the distal end of the neck portion to near the proximal end thereof into his mouth and does not enter the support portion and the pressed portion, so that his lip can be prevented from being pinched between the pressed portion and the support portion when pressing the pressed portion in a direction of approaching the support portion.

Moreover, when pressing the pressed portion against the support portion, the pressed portion and at least a part of it is elastically transformed in a direction of placing the tooth cleaning member in contact with the teeth or gums. Thus, the head angle at the distal end of the neck portion is changed in a direction of placing the tooth cleaning member in contact with the teeth and gums, thereby optionally adjusting the contact angle of the tooth cleaning member to teeth by controlling the pressing force of the pressed portion.

In addition, the handle for the tooth cleaning member constructed as above is of simple construction and, therefore, easy to be manufactured, thereby enabling high production efficiency at low cost.

In the handle for a tooth cleaning member of the present invention, when the pressed portion is pressed against the support portion, at least one of the pressed portion and the support portion is elastically transformed in a direction of decreasing a hollowing area defined between the pressed portion and the support portion to tilt the neck portion in a direction of placing the tooth cleaning member in contact with the teeth or gums.

With such a structure, the tilt angle of the neck portion is changed by controlling the pressing force of the pressed portion, whereby the head at the distal end of the neck portion can be smoothly adjusted to a proper angle for cleaning teeth.

In the handle for a tooth cleaning member of the present invention, the neck portion extends forward in the shape of a rod from the integrated distal ends of the support portion and the pressed portion.

With such a structure, the user can easily enter the tooth cleaning member at the distal end of the neck portion and the neck portion into his mouth.

In the handle for a tooth cleaning member of the present invention, the pressed portion has a low-rigidity part with a rigidity lower than that of the support portion and capable of being transformed in a direction of approaching the support portion.

With such a structure, the pressed portion can be elastically transformed when pressing it, thereby enhancing manipulability.

In the handle for a tooth cleaning member of the present invention, the support portion has a low-rigidity part with a rigidity lower than that of the other part, the low-rigidity part being disposed near the proximal end of the neck portion.

With such a structure, when pressing the pressed portion against the support portion, the neck portion having at its distal end the head portion for supporting the tooth cleaning member can be greatly tilted in a direction of placing it in contact with the teeth and gums.

In the handle for a tooth cleaning member of the present invention, the support portion and the pressed portion may be integrally molded out of a synthetic resin.

With such a structure, since the handle for a tooth cleaning member is molded integrally out of a synthetic resin, it can be easily manufactured at a low cost with high production efficiency.

In the handle for a tooth cleaning member of the present invention, the support portion and the pressed portion may be separately molded and both ends of the support portion are inseparably coupled to both ends of the pressed portion, respectively.

With such a structure, the material of the pressed portion can be selected according to its purposes.

In the handle for a tooth cleaning member of the present invention, both ends of the support portion may be removably coupled to both ends of the pressed portion.

With such a structure, when the support portion and the pressed portion become dirty, they can be separately washed to be kept clean for use.

In the handle for a tooth cleaning member, engagement grooves may be provided at the ends of the support portion, respectively. Both ends of the pressed portion may be inserted into the engagement grooves, and may have engagement stops, respectively. The engagement stops prevent the pressed portion from exiting from the engagement grooves when a tensile force is applied to the pressed portion inserted into the engagement grooves.

With such a structure, once both ends of the pressed portion are inserted into the engagement grooves, the engagement stops prevent the pressed portion from exiting from the engagement grooves even if a tensile force is applied to the pressed portion. Thus, when the pressed portion is pressed against the support portion, a tensile force is generated on the pressed portion, whereby the curvature of the support portion can be adjusted.

In the handle for a tooth cleaning member of the present invention, the neck portion has a width smaller than that of the head portion and that of the support portion or the pressed portion.

With such a structure, the user can easily enter the tooth cleaning member supported at the head part of the distal end of the neck portion and the neck portion into his mouth.

In the handle for a tooth cleaning member of the present invention, the tooth cleaning member may comprise bristles of a toothbrush type.

With such a structure, the angle of the brush can be adjusted to a proper angle for cleaning teeth by controlling the force for grasping the support portion and the pressed portion in use of the toothbrush.

In the handle for a tooth cleaning member of the present invention, the tooth cleaning member may be an interdental brush body.

With such a structure, the angle of the brush can be adjusted to a proper angle for cleaning teeth by controlling the force for grasping the support portion and the pressed portion in use of the interdental brush.

A handle for a tooth cleaning member according to another aspect of the present invention comprises: a grip part having both longitudinal ends and both sides, the grip part defining an aperture which opens at both ends and being integrated at the longitudinal ends, the grip part capable of being elastically transformed to compress the aperture; a neck portion extending from one of the ends of the grip part along an longitudinal direction of the grip part; and a head part extending from a distal end of the neck portion for supporting the tooth cleaning member, wherein when the grip part is pressed to compress the aperture, the head part is bent in a direction of placing the tooth cleaning member in contact with the teeth or gums in accordance with an amount of compression of the aperture.

In this manner, when the grip part is pressed to compress the aperture, the head part is bent in accordance with an amount of compression of the aperture. Thus, the angle of the head can be adjusted desiredly for cleaning teeth within the limits of compression of the aperture by controlling the force for grasping the grip part.

In the handle for a tooth cleaning member of the present invention, the head part is arranged at the distal end of the neck portion extending substantially straight from one of the longitudinal ends of the grip part in the longitudinal direction of the grip part.

BEST MODE FOR CARRYING OUT THE INVENTION

With reference to the accompanying drawings, the best mode for carrying out the present invention will be explained hereinafter.

First Embodiment

Figure 1A:
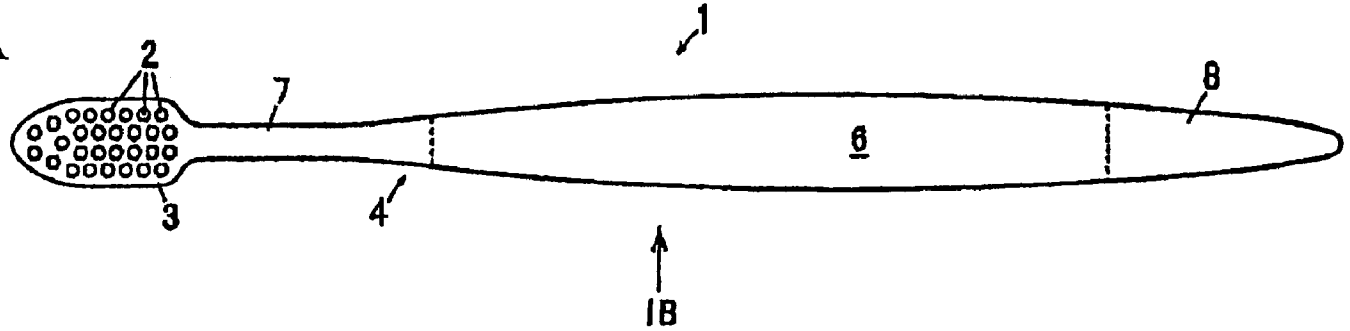
FIG. 1A is a front view of a toothbrush to which a handle for a tooth cleaning member according to a first embodiment of the present invention is applied.
Figure 1B:
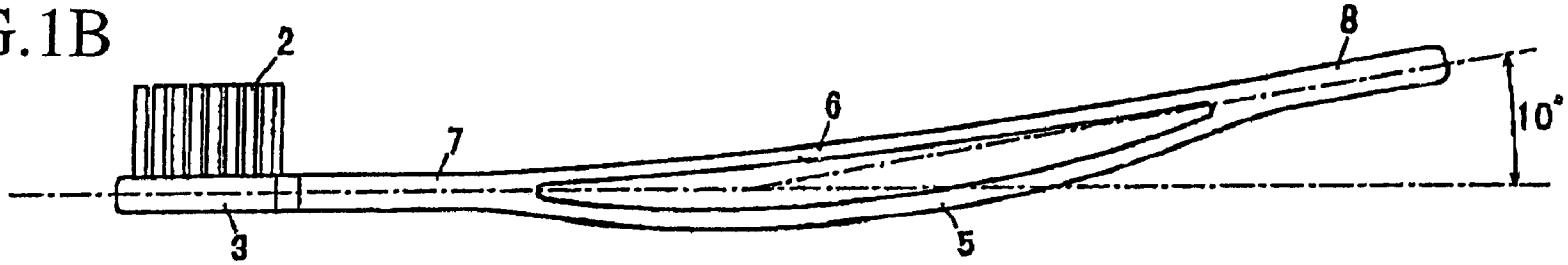
FIG. 1B is a side view in the direction of arrow IB of FIG. 1A.

FIG. 1A is a front view of a toothbrush to which a handle for a tooth cleaning member according to a first embodiment of the present invention is applied. FIG. 1B is a side view in the direction of arrow IB of FIG. 1A while FIG. 1C is a view for illustrating the toothbrush of FIG. 1B in use.

Figure 1C:
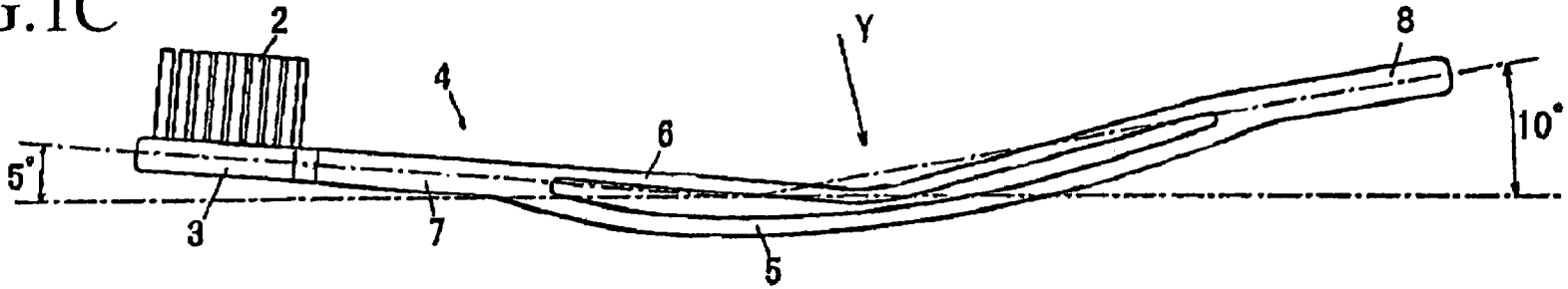
FIG. 1C is a side view of the same part as FIG. 1B in a different state from FIG. 1B.

As shown in FIGS. 1A through 1C, a toothbrush 1 has a head 3 with bristles or a brush (tooth cleaning member) 2 set therein and a handle 4 formed integrally with the head 3. The head 3 and the handle 4 may be integrally molded with each other. Alternatively, the head 3 may be constructed separately form the handle 4, and then coupled with the end of the handle 4.

The handle 4 can be made of a material that is the same as that of conventional toothbrush handles. Additionally, stainless steel and the like may be used as the material of the handle 4.

The handle 4 comprises a curvilinear support portion 5 made of an elastic material, and a pressed portion 6 made of an elastic material, a brush-side end (neck portion) 7, and a proximal end 8 (grip tail). The support portion 5 and the pressed portion 6 are integrated at both their ends and separated in their center. The pressed portion 6 is shorter than the support portion 5. The brush-side end 7 and the proximal end 8 extend from the two ends in opposite longitudinal directions of the support portion 5, respectively. The brush-side end 7 is a connection section of the head 3 to the integration part of pressed portion 6 and support portion 5. The proximal end 8 extends outwardly from the integration section of the pressed portion 6 and the support portion 5 opposite to the brush-side end 7. In regard to the brush-side end 7, the closer to the brush 2, the smaller in width, so that the handle 4 can be easy to enter the mouth of a user.

As shown in FIG. 1B, the angle between the centerline of brush-side end 7 and the centerline of proximal end 8 is 10 degrees in the usual state.

The pressed portion 6 and support portion 5 are plate-like portions. The length of the pressed portion 6 located inwardly is shorter than that of the support portion 5 located outwardly. The pressed portion 6 has a smaller thickness, so that the rigidity of the pressed portion 6 is lower than that of the support portion 5.

Namely, the pressed portion 6 and the support portion 5 are formed so as to satisfy the following expression (1):

$$L6<L5 \quad (1)$$

where L6 is the length of the pressed portion 6 and L5 is the length of the support portion 5.

In addition, the pressed portion 6 and the support portion 5 are formed so as to satisfy the following expression (2):

$$K6 \leqq K5 \quad (2)$$

where K6 is the rigidity of the pressed portion 6 and K5 is the rigidity of the support portion 5.

Although it is preferable that they satisfy the expression (2), they are not necessarily required to satisfy it.

An operation of the toothbrush will be explained next.

As shown in FIG. 1C, when the user strongly grasps the handle 4 such that the pressed portion 6 comes nearer to the support portion 5 as indicated by arrow Y, a force is applied to both ends of the curvilinear support portion 5 for pulling them toward each other, thereby transforming the support portion 5 of the handle 4 to increase the curvature as if the curvature of a bow is increased when drawing the bowstring. At this stage, the angle between the centerline of the brush-side end 7 and the centerline of the proximal end 8 changes from 10 degrees to, for example, 15 degrees. The angle of the brush 2 to teeth can be easily adjusted by adjusting the force for making the pressed portion 6 and the support portion 5 come nearer to each other (the force of grasping the handle 4). The change of angle, in turn, allows adjustment of the angle between the brush 2 supported at the head 3 secured to the end (brush-side end) 7 of the handle 4 and teeth. Thus, the user can clean his teeth adjusting the angle of the brush 2 to the teeth.

The handle 4 simply comprises the bendable support portion 5 located outwardly; the pressed portion 6 located inwardly, integrated with the support portion 5 at both ends, and separated away from the support portion 5 in the center; and the brush-side end 7 and proximal end 8 extending in opposite longitudinal directions of the support portion 5 from both ends of the support portion 5, respectively. This construction is simple and easy to be manufactured.

Second Embodiment

Figures 2A, 2B, 2C:
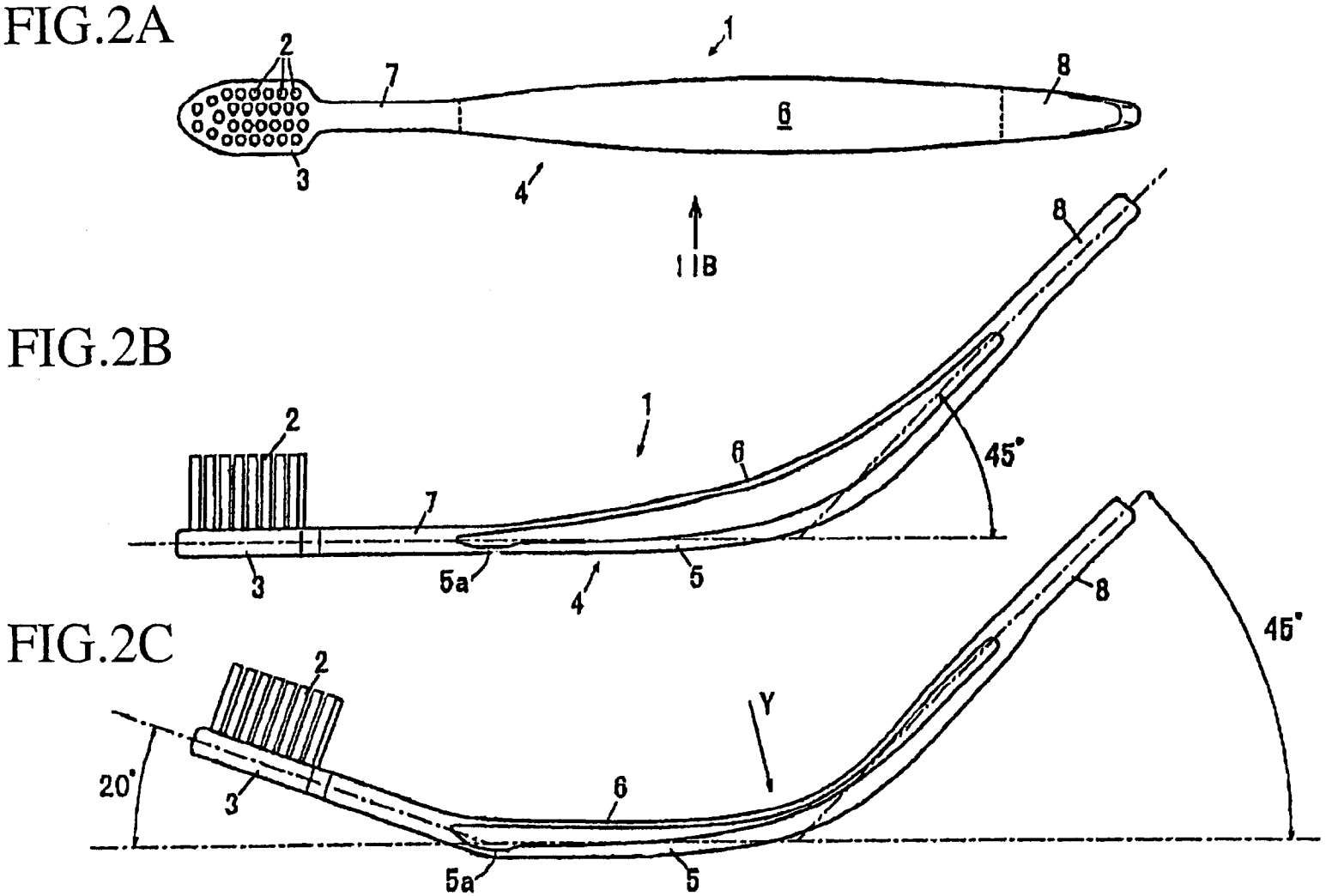
FIG. 2A is a front view of a toothbrush to which a handle for a tooth cleaning member according to a second embodiment of the present invention is applied.
FIG. 2B is a side view in the direction of arrow IIB of FIG. 2A.
FIG. 2C is a side view of the same part as FIG. 2B in a different state from FIG. 2B.

FIG. 2A is a front view of a toothbrush according to a second embodiment of the present invention. FIG. 2B is a side view in the direction of arrow IIB of FIG. 2A while FIG.

2C is a view for illustrating the toothbrush of FIG. 2B in use. In these drawings, the same reference signs as are used above are also used for identifying elements illustrated already in FIGS. 1A through 1C to avoid redundant explanation.

The toothbrush 1 of the second embodiment is constructed differently from the first embodiment in the following respects but similarly to the first embodiment in other respects.

As shown in FIG. 2B, the angle between the centerline of the brush-side end 7 and the centerline of the proximal end 8 is 45 degrees in the usual state. A thin low-rigidity part 5*a* is formed at one end of the support portion 5 neighboring on the brush-side end 7 (the end closer to the brush 2). Since the connection between the pressed portion 6 and the brush-side end 7 is closer to the distal end of the toothbrush 1 than the low-rigidity part 5*a*, the low-rigidity part 5*a* can be bent in a great degree when the pressed portion 6 is pressed against the support portion 5 to bend the support portion 5.

Next, an operation of the toothbrush will be explained.

As shown in FIG. 2C, when the user strongly grasps the handle 4 such that the pressed portion 6 comes nearer to the support portion 5 as indicated by arrow Y, the support portion 5 of the handle 4 is transformed to increase the curvature. At this stage, the angle between the centerline of the brush-side end 7 and the centerline of the proximal end 8 changes from 45 degrees to, for example, 65 degrees. The change of angle, in turn, allows adjustment of the angle between the brush 2 supported at the head 3 secured to the end (brush-side end) 7 of the handle 4 and teeth. Since the low-rigidity part 5*a*, which is close to the brush 2, is greatly bent at this stage, the angle between the brush 2 and teeth can be adjusted in a wide range.

Figure 3:
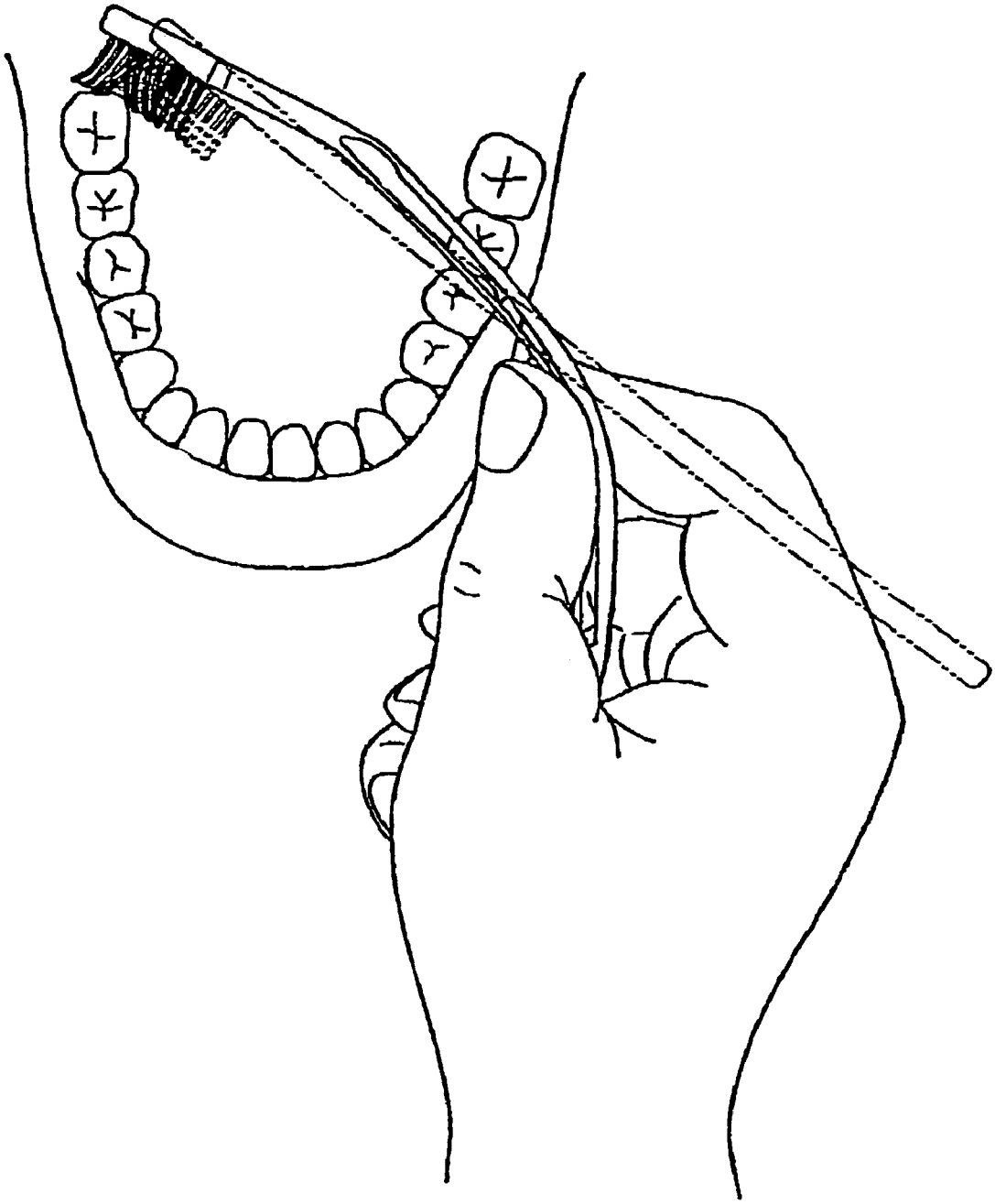
FIG. 3 shows the use of the toothbrush with the handle according to the second embodiment of the present invention.

FIG. 3 shows the use of the toothbrush of the second embodiment according to the present invention.

In FIG. 3, also illustrated by broken lines is a usual toothbrush. As will be clearly understood by the drawing, the toothbrush of the second embodiment shown by solid lines can facilitate to brush back sides of cheek teeth in comparison with the usual toothbrush shown by broken lines.

Third Embodiment

Figures 4A, 4B, 4C:
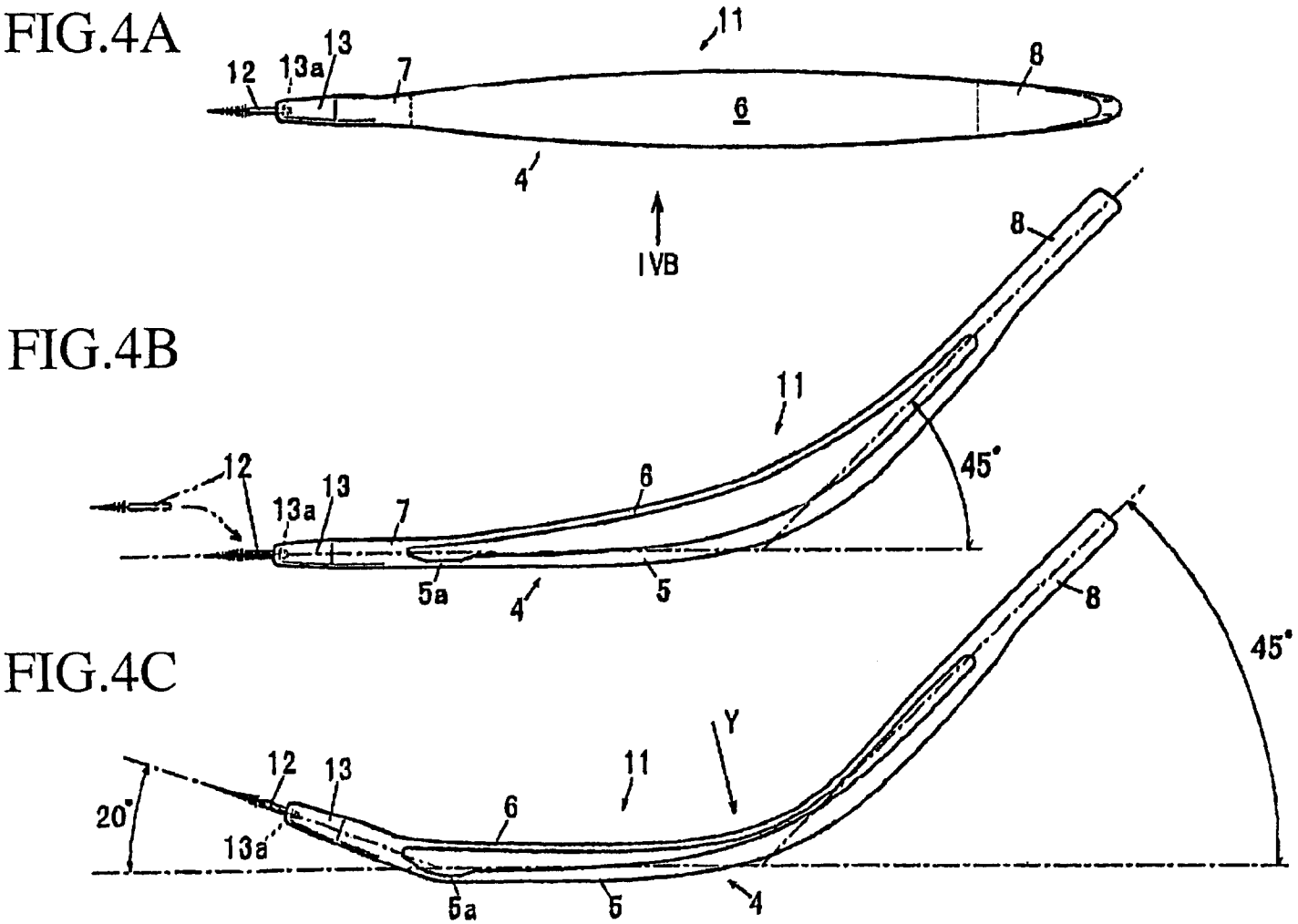
FIG. 4A is a front view of a toothbrush to which a handle for a tooth cleaning member according to a third embodiment of the present invention is applied.
FIG. 4B is a side view in the direction of arrow IVB of FIG. 4A.
FIG. 4C is a side view of the same part as FIG. 4B in a different state from FIG. 4B.

FIG. 4A is a front view of an interdental brush to which a handle for a tooth cleaning member according to a third embodiment of the present invention is applied.

FIG. 4B is a side view in the direction of arrow IVB of FIG. 4A while FIG. 4C is a view for illustrating the interdental brush of FIG. 4B in use.

In these drawings, the same reference signs as are used above are also used for identifying elements illustrated already in FIGS. 1A through 3 to avoid redundant explanation.

The interdental brush 11 of the third embodiment is constructed differently from the second embodiment in the following respects but similarly to the second embodiment in other respects.

As shown in FIGS. 4A to 4C, the interdental brush 11 of the third embodiment has the handle 4 which is the same as in the toothbrush 1 of the second embodiment. A head 13 with a hole 13*a* for receiving a brush body 12 is integrally formed with the distal end of the brush-side end 7 of the handle 4. The brush-side end 7 and the head 13 are formed straight while the angle between the centerline of head 13 and the centerline of proximal end 8 is 45 degrees. The interdental brush body (tooth cleaning member) 12 extends along the same direction as the centerline of head 13 and can be removably attached to the hole 13*a*. When the cleaning ability of the interdental brush body 12 has deteriorated due to friction, the brush body 12 may be replaced with a new one.

Similarly to the second embodiment, when the support portion 5 of the handle 4 according to the third embodiment is bent, the low-rigidity part 5*a* is bent in a great degree.

Next, an operation of the interdental brush will be explained.

As shown in FIG. 4C, when the user strongly grasps the handle 4 such that the pressed portion 6 comes nearer to the support portion 5 as indicated by arrow Y, the support portion 5 of the handle 4 is transformed to increase the curvature. At this stage, the angle between the centerline of the brush-side end 7 and the centerline of the proximal end 8 changes from 45 degrees to, for example, 65 degrees. The change of angle, in turn, allows adjustment of the angle between the brush body 12 supported at the head 3 secured to the end (brush-side end) 7 of the handle 4 and teeth. At this stage, the low-rigidity part 5*a*, which is close to the brush body 12, is greatly bent to facilitate cleaning between cheek teeth.

Fourth Embodiment

Figures 5A, 5B, 5C:
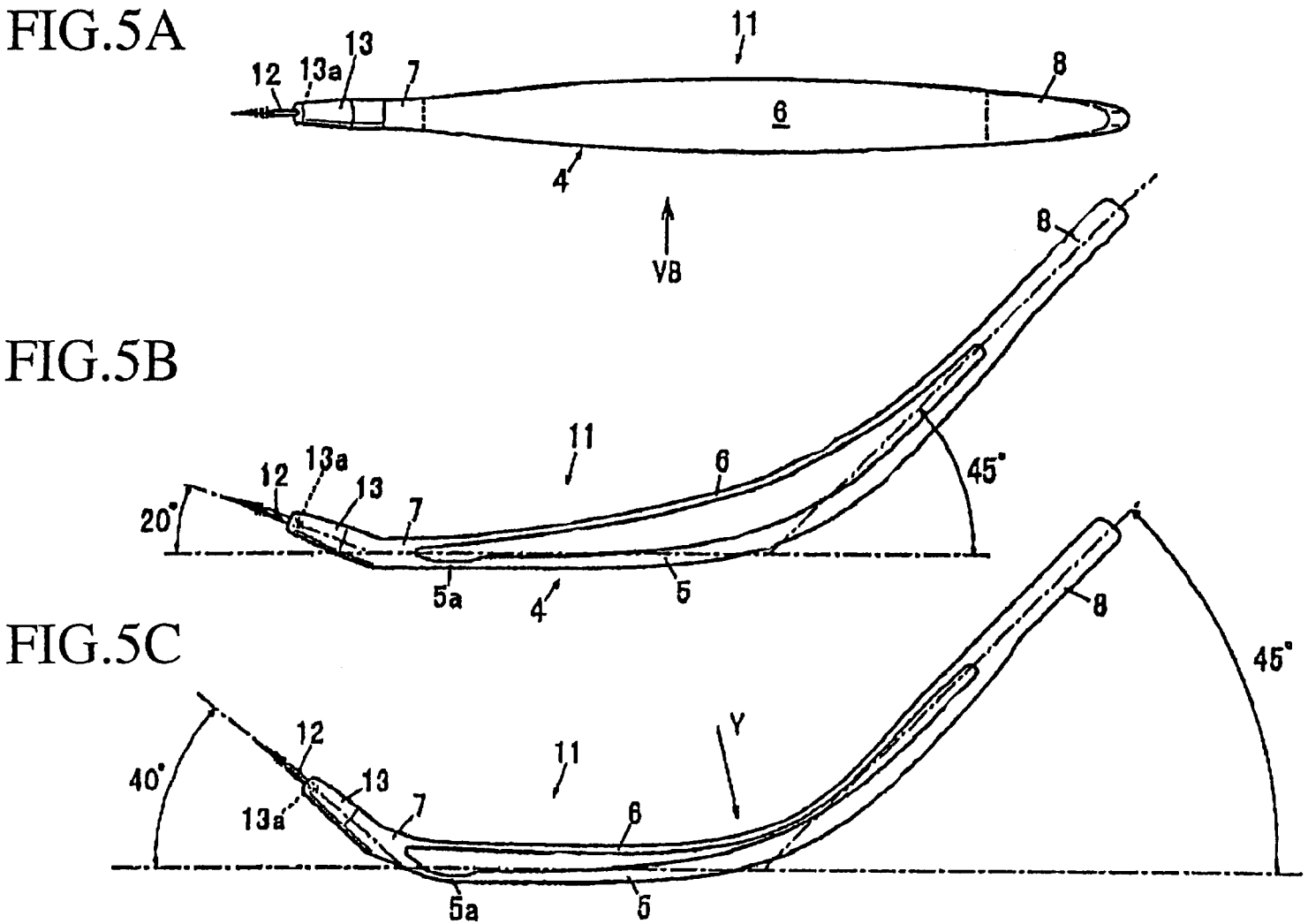
FIG. 5A is a front view of an interdental brush to which a handle for a tooth cleaning member according to a fourth embodiment of the present invention is applied.
FIG. 5B is a side view in the direction of arrow VB of FIG. 5A.
FIG. 5C is a side view of the same part as FIG. 5B in a different state from FIG. 5B.

FIG. 5A is a front view of an interdental brush to which a handle for a tooth cleaning member according to a fourth embodiment of the present invention is applied.

FIG. 5B is a side view in the direction of arrow VB of FIG. 5A while FIG. 5C is a view for illustrating the interdental brush of FIG. 5B in use.

In these drawings, the same reference signs as are used above are also used for identifying elements illustrated already in FIGS. 1A through 4C to avoid redundant explanation.

The interdental brush 11 of the fourth embodiment is constructed differently from the third embodiment in the following respects but similarly to the third embodiment in other respects.

In the interdental brush 11 of the fourth embodiment, as shown in FIG. 5B, the angle between the centerlines of the brush-side end 7 and the proximal end 8 is 45 degrees in the usual state while the angle between the centerline of the head 13 with the interdental brush body 12 and the centerline of the brush-side end 7 is 20 degrees. Thus, the angle between the centerline of interdental brush body 12 and the centerline of the proximal end 8 is 65 degrees in the usual state.

Next, an operation of the interdental brush will be explained.

As shown in FIG. 5C, when the user strongly grasps the handle 4 such that the pressed portion 6 comes nearer to the support portion 5 as indicated by arrow Y, the support portion 5 of the handle 4 is transformed to increase the curvature. At this stage, the angle between the centerline of the brush body 12 and the centerline of the proximal end 8 changes from 65 degrees to, for example, 85 degrees. The change of angle, in turn, allows adjustment of the angle between the brush body 12 supported at the head 3 secured to the end (brush-side end) 7 of the handle 4 and teeth.

Fifth Embodiment

Figures 6A, 6B, 6C, 6D:
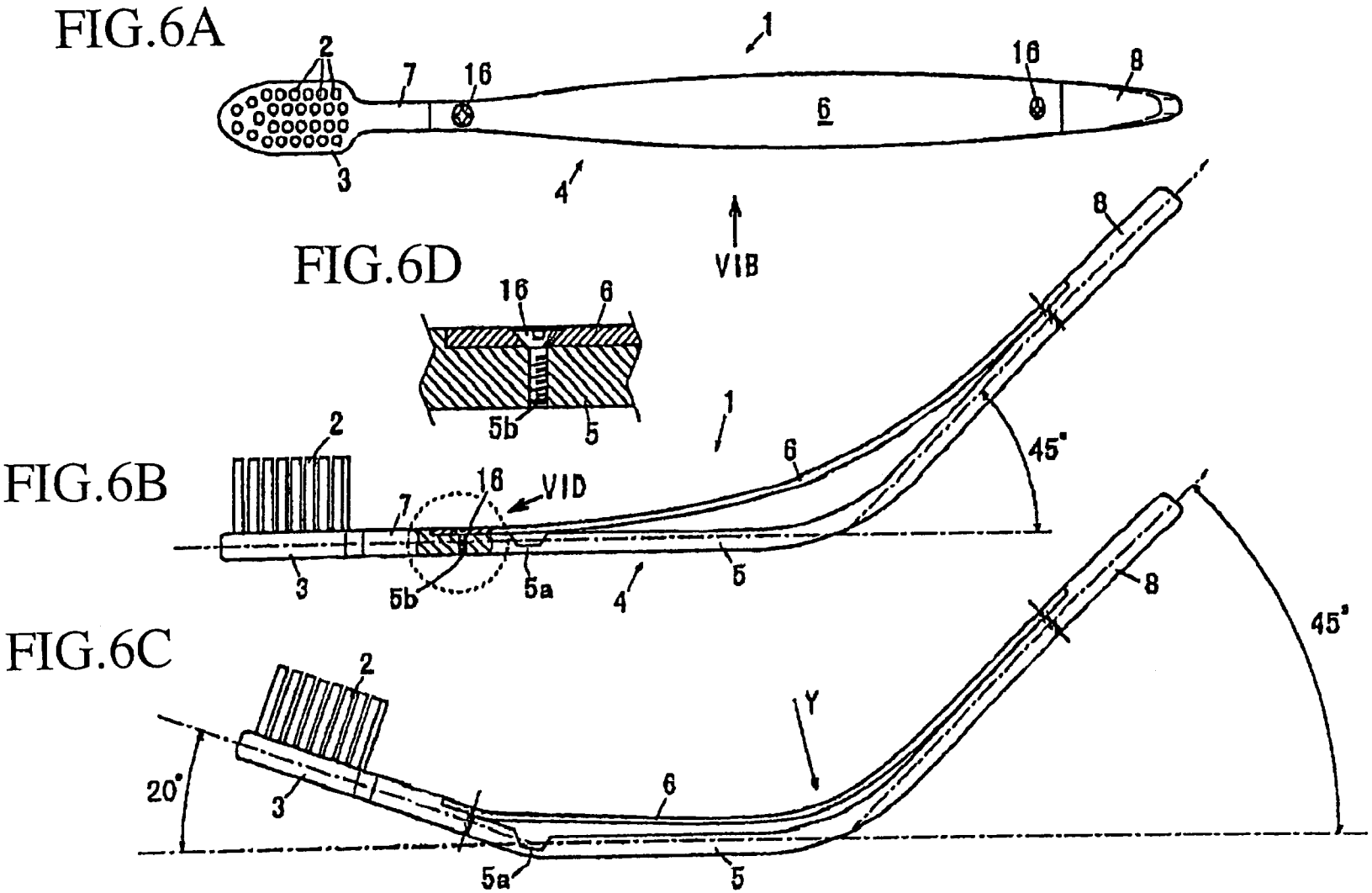
FIG. 6A is a front view of a toothbrush to which a handle for a tooth cleaning member according to a fifth embodiment of the present invention is applied.
FIG. 6B is a side view in the direction of arrow VIB of FIG. 6A.
FIG. 6C is a side view of the same part as FIG. 6B in a different state from FIG. 6B.
FIG. 6D is an enlarged view of a part indicated by arrow VID in FIG. 6B.

FIG. 6A is a front view of a toothbrush to which a handle for a tooth cleaning member according to a fifth embodiment of the present invention is applied. FIG. 6B is a side view in the direction of arrow VIB of FIG. 6A while FIG. 6C is a view for illustrating the toothbrush of FIG. 6B in use. FIG. 6D is an enlarged view of a part indicated by arrow VID.

In these drawings, the same reference signs as are used above are also used for identifying elements illustrated already in FIGS. 1A through 5C to avoid redundant explanation.

In the toothbrush 1 of the fifth embodiment, the pressed portion 6 is constructed separately from the support portion 5, and then both ends of the pressed portion 6 are secured to the support portion 5 with screws 16. The toothbrush 1 is constructed in the same manner as the second embodiment in other respects.

Similarly to the second embodiment, when the support portion 5 of the handle 4 according to the fifth embodiment is bent, the low-rigidity part 5*a* is bent in a great degree. Other operations of the fifth embodiment are similar to those of the second embodiment.

Sixth Embodiment

Figures 7A, 7B, 7C:
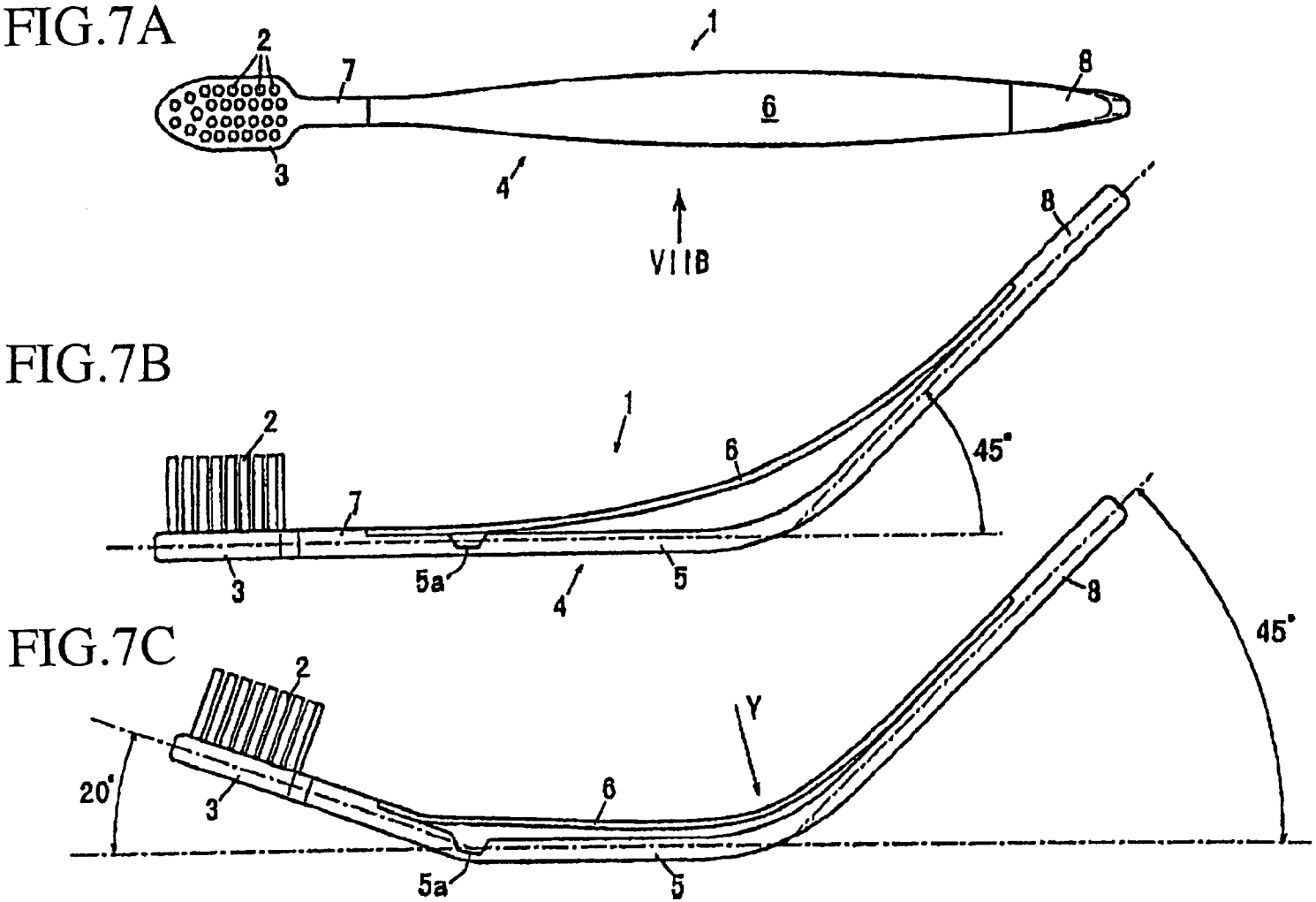
FIG. 7A is a front view of a toothbrush to which a handle for a tooth cleaning member according to a sixth embodiment of the present invention is applied.
FIG. 7B is a side view in the direction of arrow VIIB of FIG. 7A.
FIG. 7C is a side view of the same part as FIG. 7B in a different state from FIG. 7B.

FIG. 7A is a front view of a toothbrush to which a handle for a tooth cleaning member according to a sixth embodiment of the present invention is applied. FIG. 7B is a side view in the direction of arrow VIIB of FIG. 7A while FIG. 7C is a view for illustrating the toothbrush of FIG. 7B in use.

In these drawings, the same reference signs as are used above are also used for identifying elements illustrated already in FIGS. 1A through 6C to avoid redundant explanation.

In the toothbrush 1 of the sixth embodiment, the pressed portion 6 is constructed separately from the support portion 5, and then both ends of the pressed portion 6 are secured to the support portion 5 with an adhesive. The toothbrush 1 is constructed in the same manner as the second embodiment in other respects.

Similarly to the second embodiment, when the support portion 5 of the handle 4 according to the sixth embodiment is bent, the low-rigidity part 5*a* is bent in a great degree. The other operations of the sixth embodiment are similar to those of the second embodiment.

Seventh Embodiment

Figures 8A, 8B, 8C:
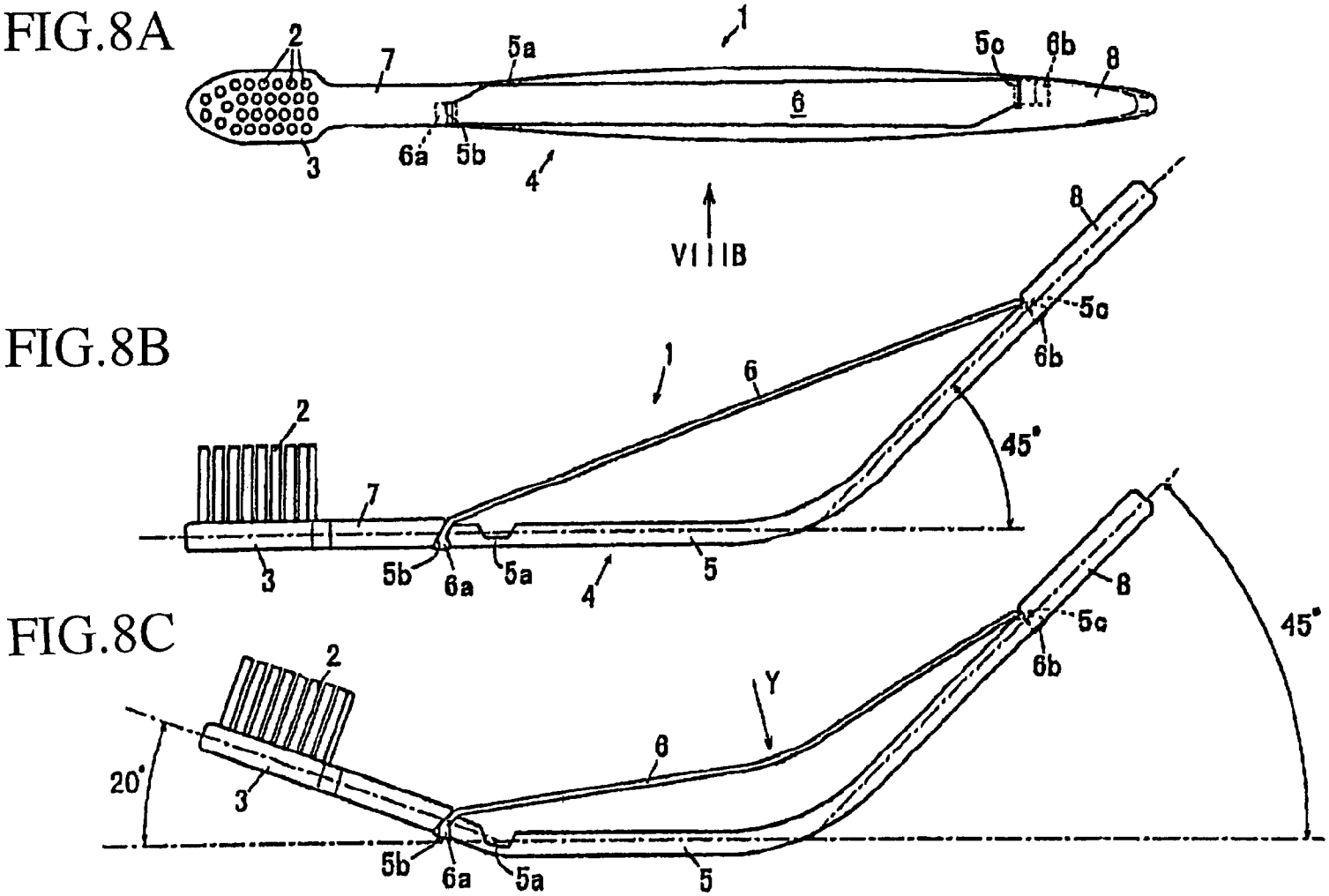
FIG. 8A is a front view of a toothbrush to which a handle for a tooth cleaning member according to a seventh embodiment of the present invention is applied.
FIG. 8B is a side view in the direction of arrow VIIIB of FIG. 8A.
FIG. 8C is a side view of the same part as FIG. 8B in a different state from FIG. 8B.

FIG. 8A is a front view of a toothbrush to which a handle for a tooth cleaning member according to a seventh embodiment of the present invention is applied. FIG. 8B is a side view in the direction of arrow VIIIB of FIG. 8A while FIG. 8C is a view for illustrating the toothbrush of FIG. 8B in use.

In these drawings, the same reference signs as are used above are also used for identifying elements illustrated already in FIGS. 1A through 7C to avoid redundant explanation.

In the toothbrush 1 of the seventh embodiment, the pressed portion 6 is constructed separately from the support portion 5, and then both ends of the pressed portion 6 are removably attached to the support portion 5.

Engagement grooves 5*b* and 5*c* are formed at both ends of the support portion 5, respectively. As shown in FIG. 8A, the engagement grooves 5*b* and 5*c* are located at opposing side surfaces of the support portion 5, respectively. The pressed portion 6 is generally comprised of a ribbon-like member made of a plastic material having engagement stops 6*a* and 6*b* at both ends thereof that are thicker than other portions.

Both ends of the pressed portion 6 are pinched into the engagement grooves 5*b* and 5*c* and the thicker stops 6*a* and 6*b* are stopped within the grooves 5*b* and 5*c*. Since the pressed portion 6 can be removed from the support portion 5, the support portion 5 and the pressed portion 6 can be washed separately when they become dirty.

Similarly to the second embodiment, when the support portion 5 of the handle 4 according to the seventh embodiment is bent, the low-rigidity part 5*a* is bent in a great degree. The other operations of the seventh embodiment are similar to those of the second embodiment.

Eighth Embodiment

Figures 9A, 9B, 9C:
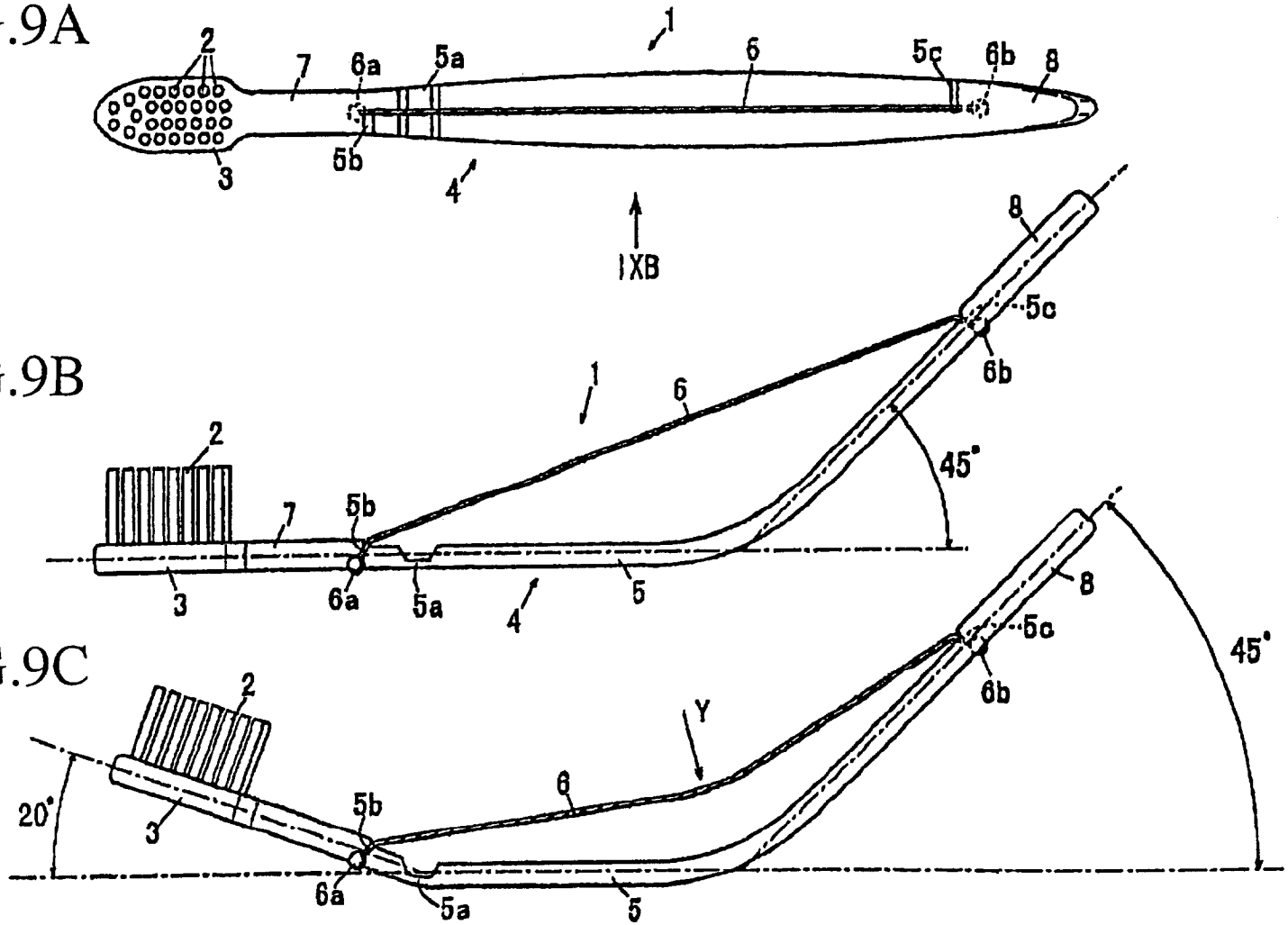
FIG. 9A is a front view of a toothbrush to which a handle for a tooth cleaning member according to an eighth embodiment of the present invention is applied.
FIG. 9B is a side view in the direction of arrow IXB of FIG. 9A.
FIG. 9C is a side view of the same part as FIG. 9B in a different state from FIG. 9B.

FIG. 9A is a front view of a toothbrush to which a handle for a tooth cleaning member according to an eighth embodiment of the present invention is applied. FIG. 9B is a side view in the direction of arrow IXB of FIG. 9A while FIG. 9C is a view for illustrating the toothbrush of FIG. 9B in use.

In these drawings, the same reference signs as are used above are also used for identifying elements illustrated already in FIGS. 1A through 7C to avoid redundant explanation.

In the toothbrush 1 of the eighth embodiment, the pressed portion 6 is constructed separately from the support portion 5, and then both ends of the pressed portion 6 are removably attached to the support portion 5.

Engagement grooves 5*b* and 5*c* are formed at both ends of the support portion 5. As shown in FIG. 9A, the engagement grooves 5*b* and 5*c* are located at opposing side surfaces of the support portion 5, respectively. The pressed portion 6 is generally comprised of a string-like member made of a plastic material having engagement stops 6*a* and 6*b* at both ends thereof that are of a spherical configuration.

Both ends of the pressed portion 6 are pinched into the engagement grooves 5*b* and 5*c* and the spherical stops 6*a* and 6*b* are stopped within the grooves 5*b* and 5*c*. Since the pressed portion 6 can be removed from the support portion 5, the support portion 5 and the pressed portion 6 can be washed separately when they become dirty.

Similarly to the second embodiment, when the support portion 5 of the handle 4 according to the eighth embodiment is bent, the low-rigidity part 5*a* is bent in a great degree. The other operations of the eighth embodiment are similar to those of the second embodiment.

Ninth Embodiment

Figure 10:
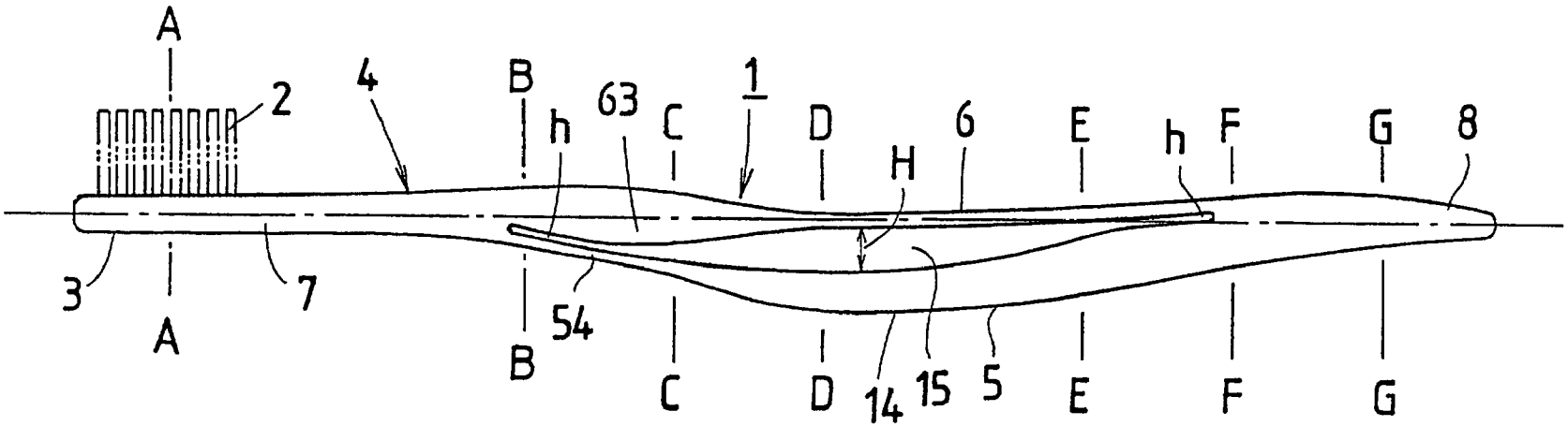
FIG. 10 is a side view of a toothbrush according to a ninth embodiment of the present invention.
Figure 10A:
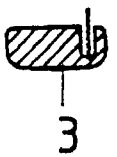
FIG. 10A is a sectional view taken along line A—A of FIG. 10.
Figure 10B:
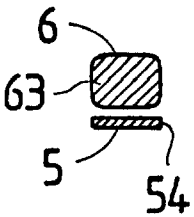
FIG. 10B is another sectional view taken along line B—B of FIG. 10.
Figure 10C:
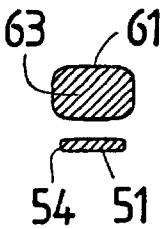
FIG. 10C is another sectional view taken along line C—C of FIG. 10.
Figure 10D:
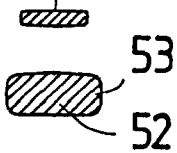
FIG. 10D is another sectional view taken along line D—D of FIG. 10.
Figure 10E:
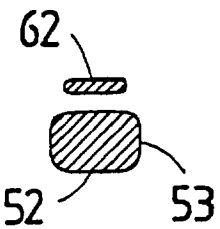
FIG. 10E is another sectional view taken along line E—E of FIG. 10.
Figure 10F:
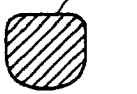
FIG. 10F is another sectional view taken along line F—F of FIG. 10.
Figure 10G:
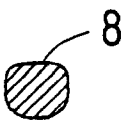
FIG. 10G is another sectional view taken along line G—G of FIG. 10.

FIG. 10 is a side view of a toothbrush according to a ninth embodiment of the present invention. FIG. 10A is a sectional view taken along line A—A of FIG. 10. FIG. 10B is another sectional view taken along line B—B of FIG. 10. FIG. 10C is another sectional view taken along line C—C of FIG. 10. FIG. 10D is another sectional view taken along line D—D of FIG. 10. FIG. 10E is another sectional view taken along line E—E of FIG. 10. FIG. 10F is another sectional view taken along line F—F of FIG. 10. FIG. 10G is another sectional view taken along line G—G of FIG. 10. In these drawings, the same reference signs as are used above are also used for identifying elements that are the same as or similar to those illustrated already in FIGS. 1A through 2C to avoid redundant explanation.

In FIG. 10, reference numeral 14 denotes a grip part of the handle 4 of the toothbrush 1. The grip part 14 defines an aperture 15 opening at both sides and is integrally formed at both longitudinal ends. The grip part 14 may be elastically transformed such that the aperture 15 may be compressed. A straight-bar-like neck portion 7 extends straight from one of longitudinal ends of the grip part 14. The head 3 is integrally formed with an end of the neck portion 7 to support the brush 2.

More specifically, the grip part 14 is comprised of the support portion 5 and the pressed portion 6, of which both ends are integrally connected to both ends of the support portion 5, respectively, to define the aperture 15 therebetween. The support portion 5 is curved entirely to protrude from the centerline of the neck portion 7 toward the direction opposing to the bristles or brush 2 at the head 3. The pressed portion 6 can be elastically transformed, so that at least a part of the pressed portion 6 comes into contact with the inner curved surface of the support portion 5. In the grip part 14, the neck portion 7 at one end and the tail part 8 at the other end are formed on the same longitudinal center axis.

Next, the configurations and structure of the support portion 5 and the pressed portion 6 will be explained in more detail. In the grasped part of the grip part 14, the width of either of the support portion 5 and the pressed portion 6 is smaller than that of the other.

Figure 11A:
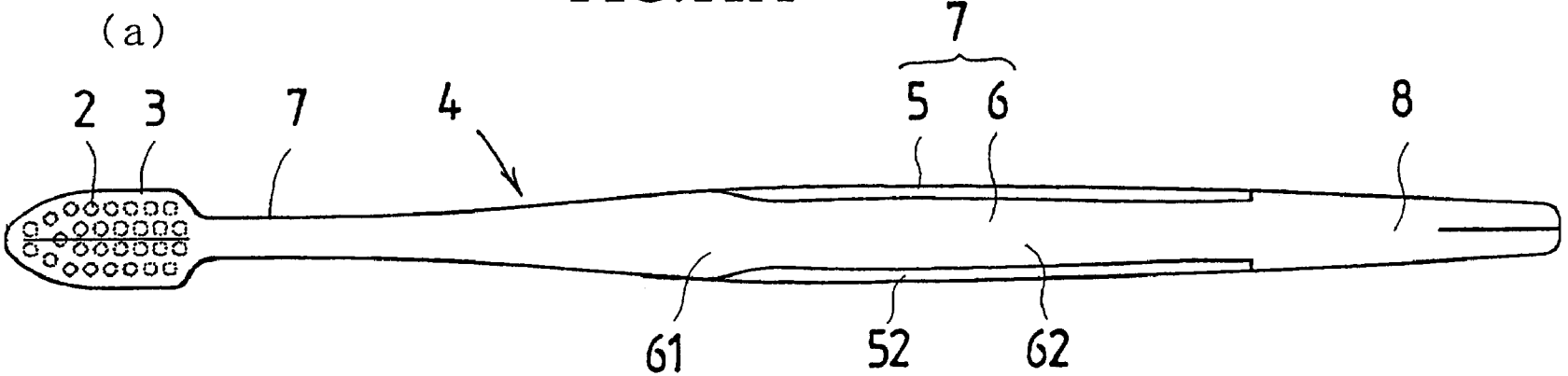
FIG. 11A is a front view of the toothbrush shown in FIG. 10.
Figure 11B:
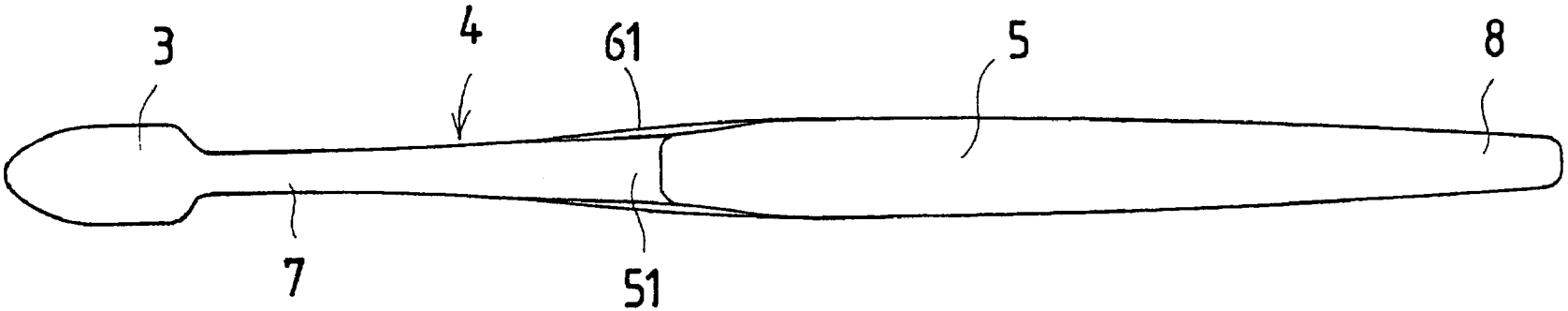
FIG. 11B is a rear view of the toothbrush shown in FIG. 10.

In particular, as shown in FIG. 11A, according to the ninth embodiment, in the grasped part of the grip part 14, the pressed portion 6 is narrower than the support portion 5. More specifically, the support portion 5 is constituted of a narrow part 51 located near one end that is nearer to the neck portion 7, and a wide part 52 extending from the narrow part 51 to the other end that is nearer to the tail part 8. The pressed portion 6 has a wide part 61 facing to the narrow part 51 of the support portion 5, and a narrow part 62 extending from the wide part 61 and facing to the wide part 52 of the support portion 5.

The wide part 52 of the support portion 5 and the narrow part 62 of the pressed portion 6 provide the grasped part of the grip part 14. The width of the narrow part 62 of the pressed portion 6 is equal to 0.35 to 0.95 times, preferably 0.5 to 0.9 times that of the wide part 52 of the support portion 5.

Both sides of the wide part 52 are formed in a hyperbolic shape such that the width of the part 52 gradually decreases as the distance to the narrow part 51 is smaller, while both sides of the wide part 61 are formed in a hyperbolic shape such that the width of the part 61 gradually decreases as the distance to the narrow part 62 is smaller. The narrow part 51 of the support portion 5 and the wide part 61 of the pressed portion 6 gradually becomes narrower as the distance to the neck portion 7 is smaller, so that the wide part 61 has the same width as that of the narrow part 51 around the integrally connected part, as shown in FIG. 10B.

The wide part 52 of the support portion 5 has a thick part 53 integrally formed with the tail part 8, the interior surface of the thick part 53 being convex. The narrow part 51 nearer to the neck portion 7 is of a thin part 54. Thus, in general, the thickness of the support portion 5 gradually becomes smaller as the view point moves from the thick part 53 to the thin part 54. In addition, a convex thick part 63 is integrally formed with the wide part 61 of the pressed portion 6, so as to face to the thin part 54 of the support portion 5. The other part of the pressed portion 6 than the thick part 63 is a substantially planar plate with a substantially uniform small thickness.

The aperture 15 defined by the support portion 5 and the pressed portion 6 has the largest gap Hat the longitudinal center of the grasped part and the smallest gap h at both longitudinal ends thereof.

Next, an operation of the toothbrush will be explained.

When the user holds the grip part 14 with a weak grip force and does not press the pressed portion 6 to compress the aperture 15, the pressed portion 6 is maintained substantially straight so that the angle of the head 3 is suitable for cleaning front teeth in his mouth, thereby allowing smooth cleaning of the front teeth. In order that the user will continuously clean his canine tooth and back teeth instead of the front teeth, when he presses the pressed portion 6 such that the aperture 15 is compressed, the pressed portion 6 is elastically transformed into a curved shape as similar to the curved inner surface of the support portion 5. In the maximum compression state, as shown in FIG. 12, the pressed portion 6 is substantially entirely contact with the inner curved surface of the support portion 5, so as to substantially close the aperture 15.

Figure 12:
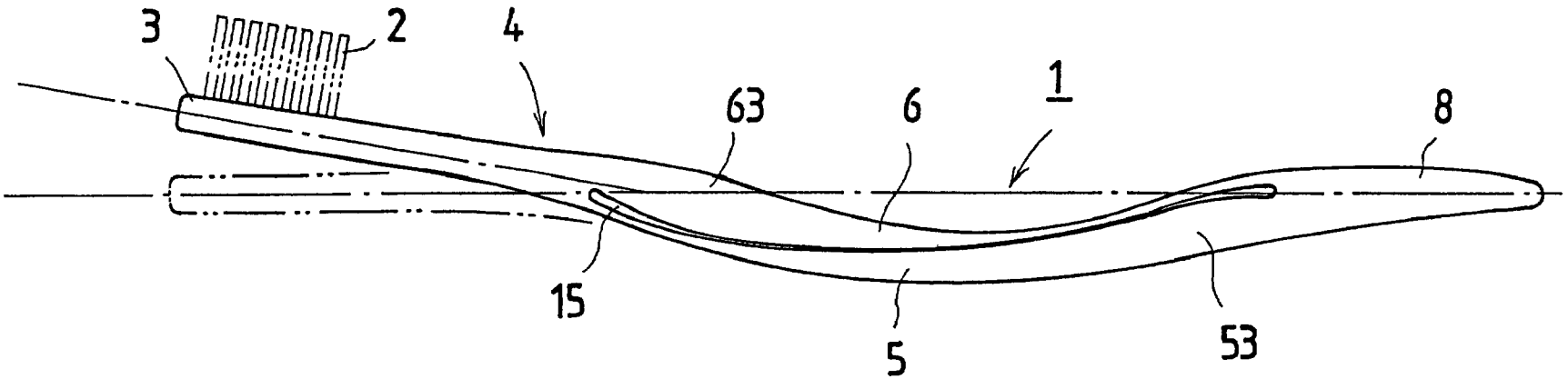
FIG. 12 is a view for illustrating an operation of the toothbrush of FIG. 10.

Thus, the user can adjust his compressing force against the pressed portion 6 within the range between the uncompressed state shown in FIG. 10 and the maximum compression state shown in FIG. 12, so that the angle of the head 3 can be changed to properly clean all teeth within his mouth.

As described above, according to the ninth embodiment, if the user holds the grip part 14 with a weak grip force and does not press the pressed portion 6 to compress the aperture 15, the grip part 14, the neck portion 7 and the tail part 8 are maintained substantially straight on the same line. As a result, the toothbrush can be used as a normal straight toothbrush. If the user grasps the grip part 14 with a strong grip force and presses the pressed portion 6 to compress the aperture 15 while controlling his pressing force, the angle of the brush can be easily adjusted to any teeth in his mouth. Thus, all teeth within the mouth can be smoothly cleaned by changing the configuration of the single toothbrush within the range between the substantially straight form and the curved form with a desired angle for cleaning teeth.

Furthermore, the grip part 14 is comprised of the support portion 5 and the pressed portion 6 of which both ends are integrally connected to both ends of the support portion 5, respectively, to define the aperture 15 therebetween. The support portion 5 is curved entirely to protrude toward the direction opposing to the brush 2 at the head 3, and the pressed portion 6 can be elastically transformed, so that at least a part of the pressed portion 6 comes into contact with the inner curved surface of the support portion 5. Thus, the pressed portion 6 can be smoothly bent to fit with the inner curved surface of the support portion 5 only by grasping the grip part 14 and pressing the pressed portion 6. Therefore, the angle of the head 3 may be easily changed to a desired cleaning angle.

Additionally, since the neck portion 7 at an end of the grip part 14 and a tail part 8 at the other end are arranged on the same longitudinal center axis, the neck portion 7 can be maintained straight along the longitudinal axis extending through the tail part 8 even when the grip part 14 near the tail part 8 is held with a small grip force using, for example, the little and third fingers. Accordingly, the toothbrush is easy to use. The appearance of the toothbrush 1 is good since the support portion 5 and the pressed portion 6 define the aperture 15 between the neck portion 7 and the tail part 8.

In addition, in at least the grasped part of the grip part 14, the width of either of the support portion 5 and the pressed portion 6 is smaller than that of the other. The construction can prevent a finger from being pinched between the support portion 5 and the pressed portion 6 when the user grasps or presses the grip part 14, so that safety is promoted.

Besides, the width of the pressed portion 6 is 0.35 to 0.95 times, preferably 0.5 to 0.9 times that of the support portion 5. Thus, the toothbrush does not provide a sense of incompatibility to the user when he grasps the grip part 14 and can provide a good appearance.

Furthermore, the support portion 5 has substantially the same width as that of the pressed portion 6 around the integrally connected part near the neck portion 7. Thus, even if the support portion 5 has a width different from that of the pressed portion 6 around the aperture 15, it is possible to ensure a good strength at the connection part. In addition, such a simple handle for a tooth cleaning member can be easily molded.

Further, the wide part 52 of the support portion 5 has a thick part 53 integrally formed with the tail part 8, the interior surface of the thick part 53 being convex. The narrow part 51 nearer to the neck portion 7 is of a thin part 54. In addition, a convex thick part 63 is integrally formed with the wide part 61 of the pressed portion 6, so as to face to the thin part 54 of the support portion 5. The other part of the pressed portion 6 than the thick part 63 is a substantially planar plate with a substantially uniform small thickness. Thus, the thick parts 53 and 63 of the support and pressed portions 5 and 6 can contribute to enhance the strength of the integrally connected parts of the support and pressed portions 5 and 6. This prevents the integrally connected parts of the support and pressed portions 5 and 6 from being broken although repetitive pressing force is applied to the pressed portion 6. In addition, the inner surfaces of the thick parts 53 and 63 are convex while the parts facing to the thick parts 53 and 63 are thin. Thus, when pressing the grip part 14, the thin parts of the pressed and support portions 5 and 6 can be smoothly elastically transformed to fit with the convex surfaces of the thick parts 53 and 63 of the portions 5 and 6, respectively, thereby enhancing manipulability.

Furthermore, the aperture 15 formed between the support portion 5 and the pressed portion 6 has the largest gap H in the longitudinal center of the grasped part and the smallest gap h at both longitudinal ends. The maximum aperture gap Hallows the angle of the neck portion 7 to be changed in a great degree. In other words, the angle of the neck portion can be varied within a range defined by the maximum aperture gap H.

Additionally, the parts of the support portion 5 and the pressed portion 6 facing to the thick parts 53 and 63 are thin. Thus, when grasping the grip part 14, the thin parts are easier to be bent, and therefore, the angle of the neck portion 7 can be more easily changed.

Tenth Embodiment

Figure 13:
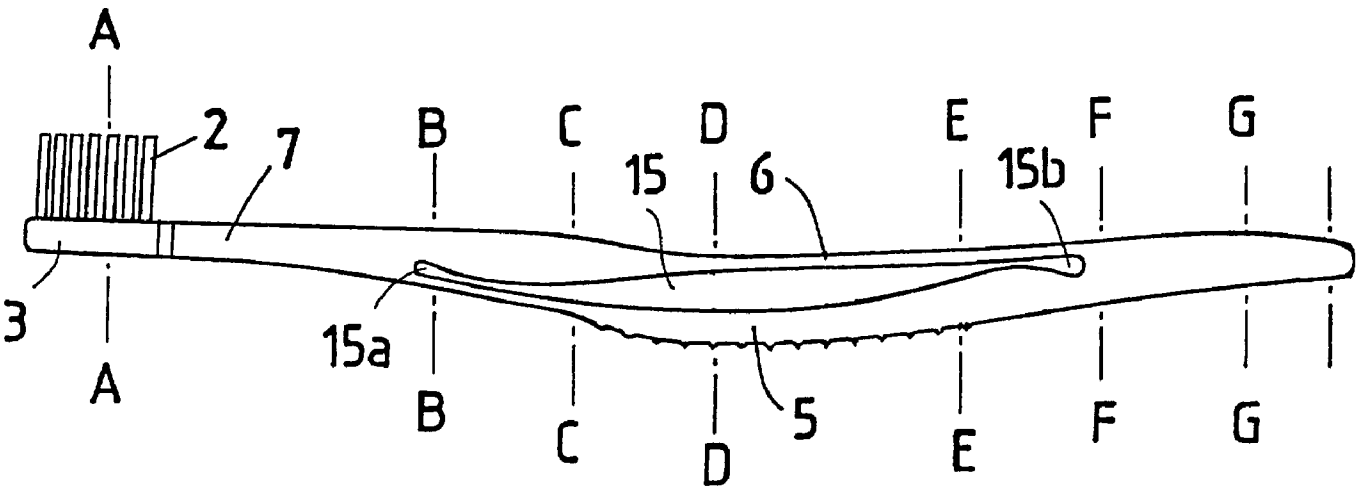
FIG. 13 is a side view of a toothbrush according to a tenth embodiment of the present invention.
Figure 13A:
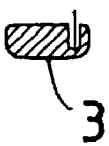
FIG. 13A is a sectional view taken along line A—A of FIG. 13.
Figure 13B:
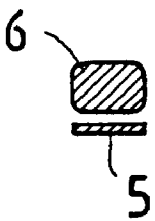
FIG. 13B is another sectional view taken along line B—B of FIG. 13.
Figure 13C:
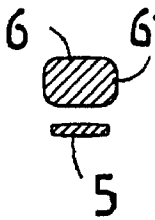
FIG. 13C is another sectional view taken along line C—C of FIG. 13.
Figure 13D:
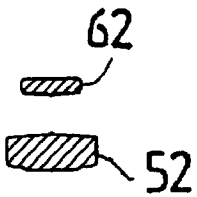
FIG. 13D is another sectional view taken along line D—D of FIG. 13.
Figure 13E:
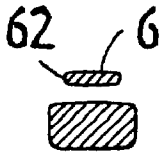
FIG. 13E is another sectional view taken along line E—E of FIG. 13.
Figure 13F:
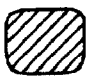
FIG. 13F is another sectional view taken along line F—F of FIG. 13.
Figure 13G:
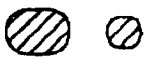
FIG. 13G is another sectional view taken along line G—G of FIG. 13.
Figure 14A:
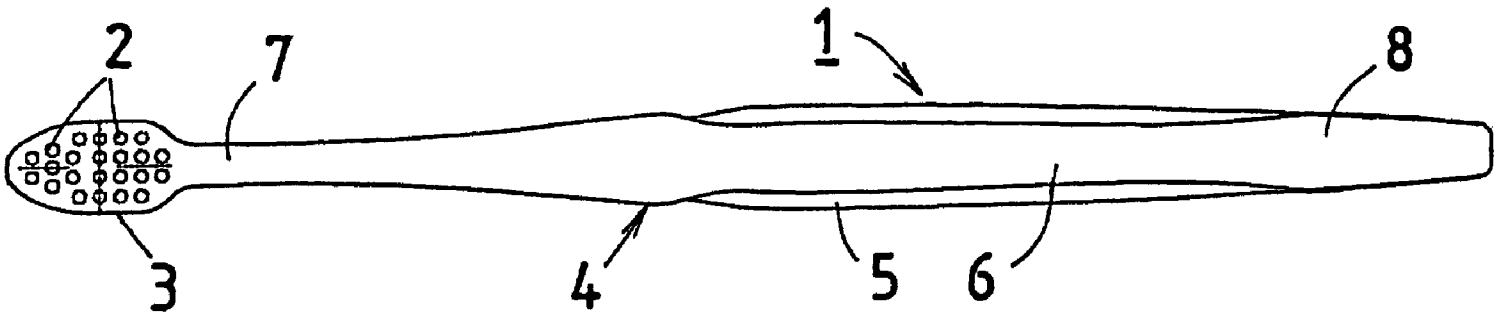
FIG. 14A is a front view of the toothbrush shown in FIG. 13.
Figure 14B:
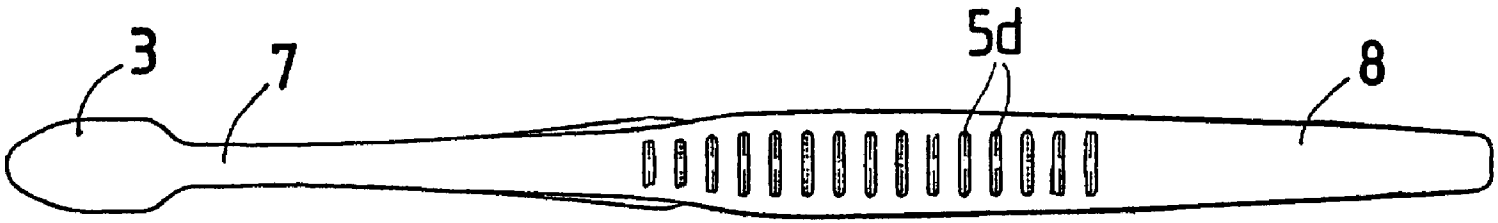
FIG. 14B is a rear view of the toothbrush shown in FIG. 13.
Figure 15:
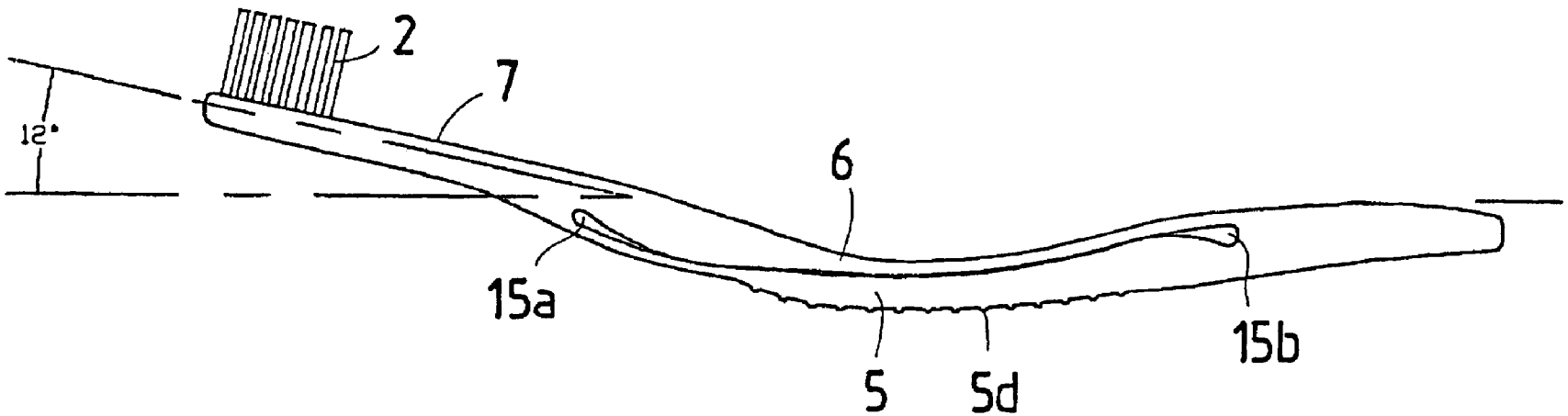
FIG. 15 is a view for illustrating an operation of the toothbrush of FIG. 13.

FIG. 13 is a side view of a toothbrush according to a tenth embodiment of the present invention. FIG. 13A is a sectional view taken along line A—A of FIG. 13. FIG. 13B is a sectional view taken along line B—B of FIG. 13. FIG. 13C is a sectional view taken along line C—C of FIG. 13. FIG. 13D is a sectional view taken along line D—D of FIG. 13. FIG. 13E is a sectional view taken along line E—E of FIG. 13. FIG. 13F is a sectional view taken along line F—F of FIG. 13. FIG. 13G is a sectional view taken along line G—G of FIG. 13. In these drawings, the same reference signs as are used above are also used for identifying elements that are the same as or similar to those illustrated already in FIGS. 1A through 2C and 10 through 10G to avoid redundant explanation.

In FIG. 13, reference numeral 5*d* denotes projections for preventing slip placed on the outer surface of the support portion 5 of the grip part 14. Holes 15*a* and 15*b* are formed so as to communicate with both longitudinal ends of the aperture 15 for facilitating to clean the handle and to mold the handle. The holes 15*a* and 15*b* have a round or streamline shape.

According to the tenth embodiment, since the slip-preventive projections 5*d* are formed on the outer surface of the support portion 5, it is easier to manipulate the toothbrush when pressing the grip part 14 and cleaning teeth.

Furthermore, since the holes 15*a* and 15*b* of a round or streamline shape are formed at both longitudinal ends of the aperture 15, it is easy to insert a bar-like cleaning tool, such as a swab, into the holes, thereby cleaning the inner surface of the aperture easily.

Furthermore, when the handle 4 for a tooth cleaning member is molded out of a resin material, turbulence of the resin material occurs near the parts encircling the holes 15*a* and 15*b*, so that the resin material can flow throughout the molding die for molding the handle 4. Thus, it is easy to mold the handle 4 out of a resin material and to remove the formed handle from the die, resulting in a long lifetime of the die.

Eleventh Embodiment

In accordance with an eleventh embodiment of the present invention, the neck portion 7 of the ninth and tenth embodiments may be of a cross sectional area smaller than that of the grip part 14 in the handles for a tooth cleaning member. Since the sectional area of the neck portion 7 is less than that of the grip part 14, if the user holds and presses the grip part 14, the neck portion 7 is easily bent and can be easily adjusted to a desired angle for cleaning tooth.

Twelfth Embodiment

In accordance with a twelfth embodiment, a handle for a tooth cleaning member may include an additional member (not shown) being of substantially the same shape as the aperture 15 in the non-compressed state. The additional member may be removably inserted into the aperture 15.

The insertion of the additional member having substantially the same shape as the aperture 15 into the aperture 15 of the grip part 14 enables the toothbrush to be used as a substantially straight toothbrush since the grip part 14 cannot be elastically transformed. In addition, the insertion and withdrawal of the additional member into and from the aperture 15 makes the inner surface of the aperture 15 be easily cleaned.

In a handle for a tooth cleaning member according to each of the above mentioned embodiments, the support portion 5 may be manufactured of any suitable materials including ABC resins, polypropylene resins, polycarbonate resins, polyester resins, acrylic resins, cellulose derivatives, and thermoplastic elastomers.

If the support portion 5 and the pressed portion 6 are molded integrally with each other, the same material as that of the support portion 5 is used as a material of the pressed portion 6. On the contrary, if the support portion 5 and the pressed portion 6 are separately formed and then integrally connected at the ends thereof, materials other than that of the support portion, e.g., nylon, may be used as a material of the pressed portion 6.

Modifications

While the present invention has been described, it is not intended to limit to the scope of the invention to the embodiments described above. It should be noted that various modifications might be devised by those skilled in the art within the spirit and scope of the present invention as defined in the appended claims. Examples of modifications will be described below.

When the support portion 5 and the pressed portion 6 are formed as separate members as shown in FIGS. 6 to 9, it is possible to removably secure them to each other by any one of various methods other than those exemplified in the above embodiments.

In the handles for a tooth cleaning member according to the ninth embodiment and the tenth embodiment, the support portion 5 and the pressed portion 6 may be separately formed, and then both ends of the pressed portion 6 may be fixedly coupled to the inner curved surface of the support portion 5 by proper securing means, such as bolts or an adhesive in a manner similar to the methods shown in FIGS. 6A to 9B. Furthermore, the support and pressed portions 5 and 6 may be removably coupled to each other.

If the support and pressed portions 5 and 6 are manufactured as separate members, they are preferably made of the same synthetic resin, but they may be made of different materials. For example, the support portion 5 may be made of a resin material while the pressed portion 6 may be made of a metallic plate spring. Both ends of the pressed portion 6 may be then removably coupled to the support portion 5.

In the handle for a tooth cleaning member according to the ninth or tenth embodiment, the head 3 is not limited to the shapes shown in the drawings, and may be designed to be various shapes. The head 3 may be a head of an interdental brush. In this case, an interdental brush body may be removably mounted on the head 3 in a manner similar to the method shown in FIG. 4.

INDUSTRIAL APPLICABILITY

As stated above, the handle for a tooth cleaning member according to the present invention has a good manipulability and is suitable for a toothbrush or interdental brush since the angle of the cleaning member can be adjusted properly for cleaning teeth by controlling the grip force on the griped part.

What is claimed is:

1. A tooth cleaning device, comprising a handle having a neck portion arranged at a longitudinal end thereof, a head portion extending from a distal end of the neck portion supporting a tooth cleaning member extending from a surface thereof, and a grip tail portion arranged at the other longitudinal end, said handle further comprising:

a support portion and a pressed portion, whose distal ends being integrated at a proximal end of the neck portion and whose proximal ends being integrated at a distal end of the grip tail portion, the support portion and the pressed portion being made of an elastic material and being separated from each other between the proximal end of the neck portion and the distal end of the grip tail portion, wherein when the pressed portion is pressed against the support portion, at least one of the pressed portion and the support portion is elastically transformed to cause the head portion to be displaced generally in the direction in which the tooth cleaning member extends from the surface of the head portion to adjust a tooth brushing angle of the head portion to a proper angle.

2. The device according to claim 1, wherein the support portion has a low-rigidity part with a rigidity lower than that of the other part, the low-rigidity part being disposed near the proximal end of the neck portion.

3. The device according to claim 1, wherein the support portion and the pressed portion are integrally molded with each other out of a synthetic resin.

4. The device according to claim 1, wherein the support portion and the pressed portion are separately molded and both of the support are inseparably or removably coupled to both end of the pressed portion, respectively.

5. The device according to claim 4, wherein engagement grooves are provided at the ends of the support portion, respectively, both ends of the pressed portion being insertable into the engagement grooves, both ends of the pressed portion having engagement stops, respectively, the tensile force is applied to the pressed portion inserted into the engagement grooves.

6. The device according to claim 1, wherein the neck portion has a width smaller than that of the head portion and that of the support portion or the pressed portion.

7. The device according to claim 1, wherein the tooth cleaning member comprises bristles of a toothbrush type.

8. The device according to claim 1, wherein the pressed portion is pressed against the support portion, at least one of the pressed portion and the support portion is elastically transformed in a direction of decreasing a hollowing area between the pressed portion and the support portion to tilt the neck portion in a direction of placing the tooth cleaning member in contact with the teeth or gums.

9. The device according to claim 1, wherein the neck portion extends forward in the shape of a rod from the integrated distal ends of the support portion and the pressed portion.

10. The device according to claim 1, wherein the pressed portion has a low-rigidity part with a rigidity lower than that of the support portion and capable of being transformed in a direction of approaching the support portion.

11. A tooth cleaning device comprising:

a grip part having both longitudinal ends and both sides, the grip defining an aperture which opens at both ends and being integrated at the longitudinal ends, the grip part capable of being elastically transformed to compress the aperture;

a neck portion extending from one of the ends of the grip part along a longitudinal direction of the grip part; and a head extending from a distal end of the neck portion supporting a tooth cleaning member extending from a surface thereof, wherein when the grip part is pressed to compress the aperture, the head part is displaced generally in the direction in which the tooth cleaning member extends from the surface of the head part in accordance with an amount of compression of the aperture.

12. The device according to claim 11, wherein the head part is arranged at the distal end of the neck portion extending substantially straight from one of the longitudinal ends of the grip part in the longitudinal direction of the grip part.

13. The device according to claim 11, wherein the grip part comprises:

an outer support portion curved entirely to protrude from a centerline of the lateral face of the neck portion toward a direction opposing to the cleaning member on the head part; and a pressed portion integrally coupled at both ends of the support portion, the aperture being defined by the pressed portion and the support portion, the pressed portion capable of being elastically transformed such that at least a part of the pressed portion can come contact with an inner curved surface of the support portion.

14. The device according to claim 13, wherein the aperture has the largest gap in a longitudinal center of the aperture and the smallest gap at both longitudinal ends of the aperture.

15. The device according to claim 13, wherein a width of one of the support portion and the pressed portion is smaller than that of the other in at least a grasped part of the grip part.

16. The device according to claim 15, wherein the width of one of the pressed portion and the support portion is 0.35 to 0.95 times that of the other.

17. The device according to claim 15, wherein the support portion and the pressed portion have parts with substantially the same width around at least one of the longitudinal ends.

18. The device according to claim 17, wherein thick parts are located at one of the longitudinal ends of the support portion and the other longitudinal end of the pressed portion, respectively, each of the thick parts having an interior surface defining the aperture, the interior surface being convex, the support portion having a thin part facing the thick part of the pressed portion and being thinner than the thick parts of the support portion and the pressed portion, the pressed portion having a thin part facing the thick part of the support portion and being thinner than the thick parts of the support portion and the pressed portion, whereby the thin parts facing the thick parts are transformable to come into contact with the thick parts of the support and the pressed portion, respectively when the grip part is grasped.

19. The device according to claim 18, wherein widths of the thin parts of the support portion and the pressed portion are smaller than widths of the thick parts of the support portion and the pressed portion.

20. The device according to claim 13, wherein the support portion comprises a narrow part located near one of the longitudinal ends and a wide part extending from the narrow part to the other of the longitudinal ends, the pressed portion compressing a first part facing the narrow part of the support portion and a second part facing the wide part of the support portion, the first part being wider than the narrow part, the second part being narrower than the wide part.

21. The device according to claim 20, wherein the support portion and the pressed portion have parts with substantially the same width around at least one of the longitudinal ends.

22. The device according to claim 21, wherein thick parts are located at one of the longitudinal ends of the support portion and the other longitudinal end of the pressed portion, respectively, each of the thick parts having an interior surface defining the aperture, the interior surface being convex, the support portion having a thin part facing the thick part of the pressed portion and being thinner than the thick parts of the support and the pressed portion, the pressed portion having a thin part facing the thick part of the support portion and being thinner than the thick parts of the support portion and the pressed portion, whereby the thin parts facing the thick parts are transformable to come into contact with the thick parts of the support portion and the pressed portion, respectively when the grip part is grasped.

23. The device according to claim 22, wherein widths of the thin parts of the support portion and the pressed portion are smaller than widths of the thick parts of the support portion and the pressed portion.

24. The device according to claim 13, wherein thick parts are located at one of the longitudinal ends of the support portion and the other longitudinal end of the pressed portion, respectively, each of the thick parts having an interior surface defining the aperture, the interior surface being convex, the support portion having a thin part facing the thick part of the pressed portion and being thinner than the thick parts of the support portion and the pressed portion, the pressed portion having a thin part facing the thick part of the support portion and being thinner than the thick parts of the support portion and the pressed portion, whereby the thin parts facing the thick parts are transformable to come into contact with the thick parts of the support and the pressed portion, respectively when the grip part is grasped.

25. The device according to claim 24, wherein widths of the thin parts of the support portion and the pressed portion are smaller than widths of the thick parts of the support portion and the pressed portion.

26. The device according to claim 11, wherein the neck portion at one end of the grip part and a tail part at the other end of the grip part are arranged on the same longitudinal center axis.

27. The device according to claim 11, wherein at least one hole of a round or streamline shape is formed so as to communicate with at least one end of the aperture for facilitating cleaning and molding.

28. The device according to claim 11, wherein a surface of the grip part is provided with slip-preventive projections.

29. The device according to claim 11, wherein a sectional area of the neck portion is less than a sectional area of the grip part.

30. The device according to claim 11, wherein the additional member of substantially the same shape as the aperture may be removably inserted into the aperture when the grip part is not compressed.

* * * * *